United States Patent [19]

Lewis

[11] Patent Number: 4,677,283

[45] Date of Patent: Jun. 30, 1987

[54] DEVICE FOR COUNTING AND LOADING SMALL ITEMS INTO CONTAINERS

[75] Inventor: Graham L. Lewis, Baie d'Urfé, Canada

[73] Assignee: H. G. Kalish Inc., Pointe Claire, Canada

[21] Appl. No.: 900,409

[22] Filed: Aug. 26, 1986

[51] Int. Cl.[4] ..... G06M 7/00

[52] U.S. Cl. ..... 235/98 C; 235/132 E; 198/383; 198/446; 198/453; 377/12

[58] Field of Search ..... 235/98 C, 98 R, 132 R, 235/132 E; 198/383, 446, 453; 377/6, 12

[56] References Cited

U.S. PATENT DOCUMENTS

| | | | |
|---|---|---|---|
| 1,079,165 | 11/1913 | Conte | 198/446 |
| 1,416,345 | 5/1922 | Gosselin | 141/170 |
| 1,842,053 | 1/1932 | Small | 198/453 |
| 2,190,620 | 2/1940 | Milmoe et al. | 198/446 |
| 2,523,517 | 9/1950 | Potter | 53/168 |
| 2,594,337 | 4/1952 | Noe | 53/244 |
| 2,656,962 | 10/1953 | Daniels | 53/244 |
| 2,762,180 | 9/1956 | Hall | 53/250 |
| 2,991,893 | 7/1961 | Kirsch et al. | 198/438 |
| 3,185,277 | 5/1965 | Agnew | 198/438 |
| 3,387,695 | 6/1968 | Hendrickson | 198/383 |
| 3,767,027 | 10/1973 | Pund et al. | 198/453 |
| 3,900,718 | 8/1975 | Seward | 235/98 C X |
| 4,024,381 | 5/1977 | Fluck | 235/98 C X |
| 4,116,323 | 9/1978 | Dragotta | 198/453 |

*Primary Examiner*—Benjamin R. Fuller

*Attorney, Agent, or Firm*—Neil W. McDermid; William H. James

[57] ABSTRACT

A counting and batching device for items such as tablets, capsules or caplets is faster than the electronic radial feeder counters, and is more easily adjustable for different quantities, sizes and shapes of items than slat counters or disk counters. The device has a hopper with an adjustable feed gate and a first vibrator to cause items to flow from the feed gate. A V-guide sorting trough is positioned beneath the feed gate having a slot at its base to hold a single row of items, and a second vibrator funnels items into a single row moving along the slot. A moving belt receives items from the trough and transports them in a single row between stationary guides past an electronic counter to a diverter where a predetermined number of items are diverted into at least two diverter streams. Loading positions are provided under each diverter stream with provision for positioning and removing containers independently into each loading position.

22 Claims, 9 Drawing Figures

91
80
62
60
62
64
78
68
66
72
70
64
60
78
74
90
72
70
54
52
52
50
46
38
36
24

DEVICE FOR COUNTING AND LOADING SMALL ITEMS INTO CONTAINERS

The present invention relates to counting and batching small items such as tablets or capsules. More specifically, the present invention relates to a high speed device for counting a predetermined number of items such as tablets or capsules and loading the predetermined number into a container.

There are many devices on the market today for counting capsules and tablets into containers such as bottles or boxes. One of the fastest type of tablet counters on the market today is a slat counter wherein slats are fitted onto a moving belt rotating through a hopper containing tablets or capsules. The slats have a predetermined number of holes, each hole is filled with a capsule or tablet from the hopper. As each slat moves to the unloading position, the predetermined number of tablets or capsules are directed into a container. Such a device is fast, however, one problem that exists with such a device is that if one has to change the tablet or capsule size, or if one has to change the number of capsules or tablets that are required to be loaded into a container, every slat has to be changed, which requires considerable down time as well as the necessity of keeping many sets of different slats.

Other types of counters available today are disk counters wherein a disk rotates and has a series of holes in the disk to hold tablets. The holes in the disk are filled at one area of the machine and the capsules or tablets fall out of the holes at another area as the disk rotates, and are diverted into a container. Again each disk has to be selected for a predetermined number of capsules or tablets of the same size. If there is a change in the number of tablets or capsules or the size of tablet or capsules, then the disk must be replaced and this in turn requires considerable down time.

Other types of counters include electronic radial feeder counters which are used with capsules and tablets as well as other items. In some cases, the radial feeder has a disk that rotates and in other cases, the disk vibrates. The items are directed into a single line, the items counted and a predetermined number of items are diverted into a container. One example of such a counter is shown in U.S. Pat. No. 2,523,517 to Potter.

The aim of the present invention is to provide a device that counts items such as tablets or capsules at speeds that approach the speed of a slat counter type of machine and does not require replacement parts to change the number of items to be counted or the size of the items. Furthermore, it is another aim of the present machine to provide loading stations where containers such as bottles or boxes are independently fed to a loading station and are not dependent upon containers in other loading stations.

It is a further aim of the present invention to provide a high speed tablet or capsule counter that handles any shape and size of tablet, capsule or capsule shaped tablet (caplet). The device may have at least one single line loading channel dividing into two diverter streams, or alternatively, may be multi-channelled, each channel dividing into two diverter streams. The device may be taken to pieces easily for cleaning and adjustment to different size and number of items. Furthermore, the device has a unique sorting trough to arrange the items in single file, and in a preferred embodiment, provision is made to prevent items from overfilling the trough.

The present invention provides a device for counting and loading a predetermined number of items into containers, comprising:

(A) a hopper for holding a plurality of items to be counted and loaded, the hopper having an adjustable feed gate to vary flow rate of items from the hopper, first vibrating means to cause the items to flow from the feed gate;

(B) V-guide sorting trough positioned beneath the feed gate, the trough having a slot at the bottom of the trough to hold a single row of items, second vibrating means attached to the trough to funnel items into a single row moving along the slot;

(C) moving belt means for receiving items from the slot, the belt means having two vertical stationary guides positioned above the belt means to maintain a single row of items therebetween on the belt means;

(D) electronic counting means to count a predetermined number of items moving in the single row on the belt means;

(E) diverter means to direct the predetermined number of items into one of at least two diverter streams, and (F) loading position under each of the diverter streams with means for positioning and removing containers into each loading position independently.

The device may be used for circular tablets which roll on edge in the slot at the bottom of the trough and between the guides above the belt means. The device may also be used for capsules or caplets. The width of the slot at the bottom of the sorting trough and the distance between the two guides above the belt means may be adjusted for different sizes of items. The V-guide sorting trough may be sloped, and the belt means may slope and move downwards. The slope of the V-guide sorting trough and slope and speed of the belt means may be adjusted for different sizes of items and different flow rates.

A photo-sensor means in one embodiment is positioned above the V-guide sorting trough to sense a pile up of items in the trough and turn off the first vibrating means causing the flow of items from the feed gate to cease. In one embodiment, the diverter means includes two air jets positioned one on either side of the single row of items moving along the belt means to divert the items into a first diverter stream and a second diverter stream, air being directed from only one jet at a time, and being switched to the other jet when the counting means counts the predetermined number of items.

In a further embodiment, a container input conveyor is provided on one side of the loading positions, and a container output conveyor on the other side of the loading positions; stop means are also provided to hold empty containers on the input conveyor adjacent each of the loading positions, and independent ram means for each of the loading positions for pushing an empty container into each of the loading positions, the empty container displacing a full container from each of the loading positions onto the output conveyor. Each of the loading positions can be changed to suit different sized containers.

In drawings which illustrate embodiments of the invention:

Figure 1:
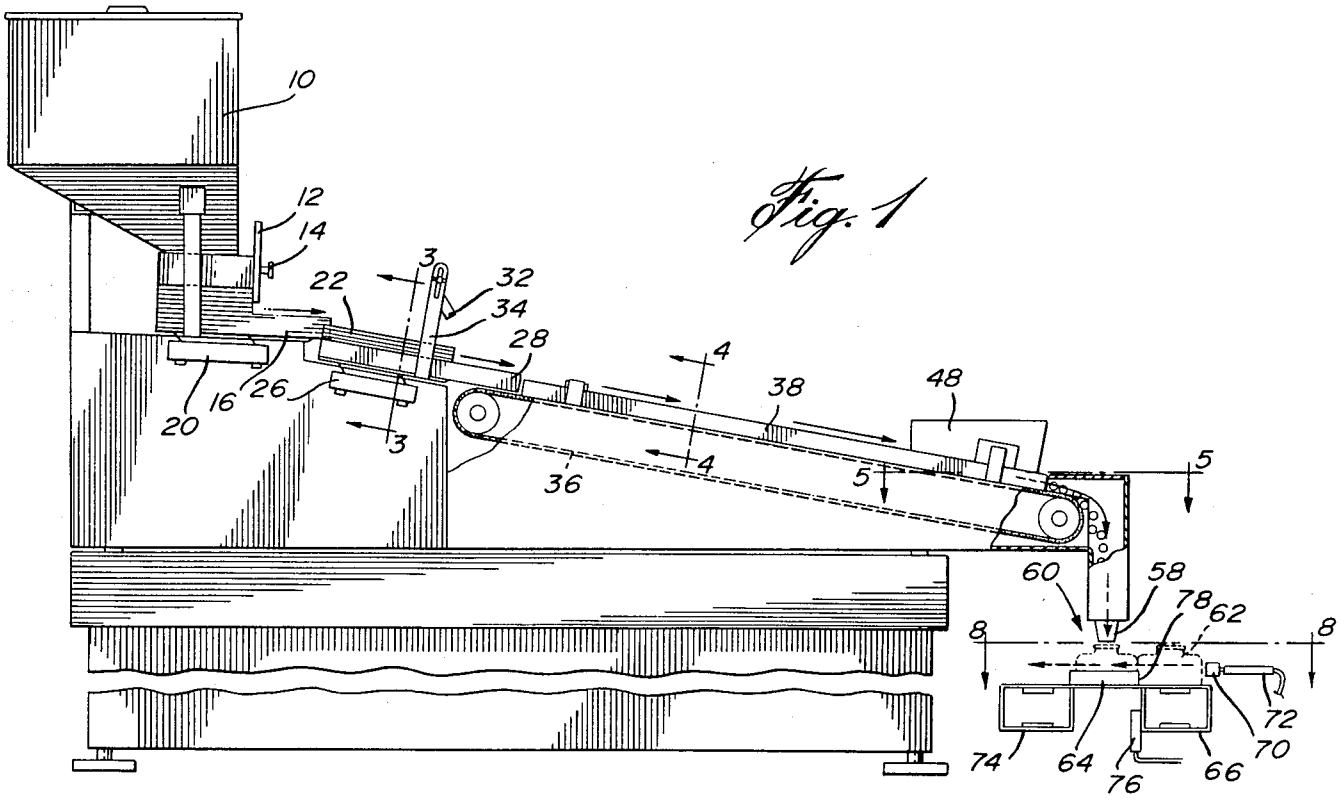
FIG. 1 is a schematic side elevational view showing a counting device according to one embodiment of the present invention.
Figure 2:
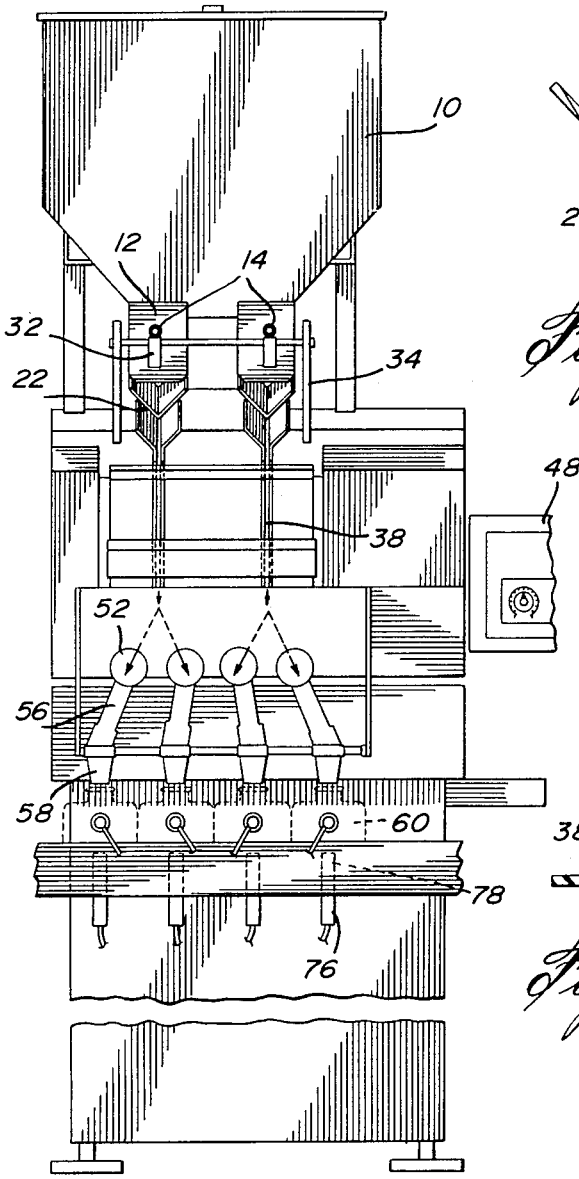
FIG. 2 is a schematic end view of the device shown in FIG. 1.

Referring now to the drawings, FIGS. 1 and 2 illustrate one embodiment of a device for counting and loading a predetermined number of items into containers. The device has a hopper 10 for holding items such as capsules, tablets or caplets. A feed gate 12 is positioned at the bottom of the hopper 10 and has an adjusting screw 14 to control the opening of the feed gate 12 thus controlling the flow rate of items leaving the hopper. The adjustable opening is also necessary for different sizes of tablets or capsules. The feed gate 12 has a V-shaped face to match a V-shaped extension piece 16 leading to the next portion of the device. A first vibrator 20 is positioned below the extension piece 16 which slopes forward so that when it is vibrated, items flow from the feed gate 12 and drop off the end of the extension piece 16.

Figure 3:
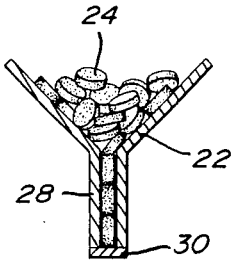
FIG. 3 is a cross sectional view through the sorting trough taken at line 3—3 of FIG. 1.

The items fall off the extension piece 16 into a sloping V-guide sorting trough 22 as shown in FIG. 3. The items 24 are vibrated by a second vibrator 26 attached to the trough 22 and fall into a slot 28 at the bottom of the trough 22 and integral therewith. The items 24 are retained in the slot by a bottom plate 30. The slot 28 is adjustable for size to take into account different sizes of items 24 and is arranged so that they form into a single row, although as can be seen in FIG. 3, the row may be multi-tiered. The slope of the trough 22 and slot 28 is such that the items 24 advance in a single row when the second vibrator 26 is turned on. A photo-sensor 32 is supported on an arm 34 above the trough 22 and if a pile up of items 24 occurs on the trough 22, it is detected by the photo sensor 32 which turns off the first vibrator 20 hence stopping the flow of tablets or capsules from the hopper 10.

Figure 4:
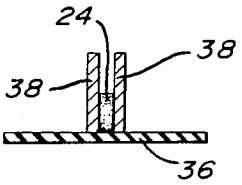
FIG. 4 is a cross sectional view through the stationary guides above the belt taken at line 4—4 of FIG 1.
Figure 6:
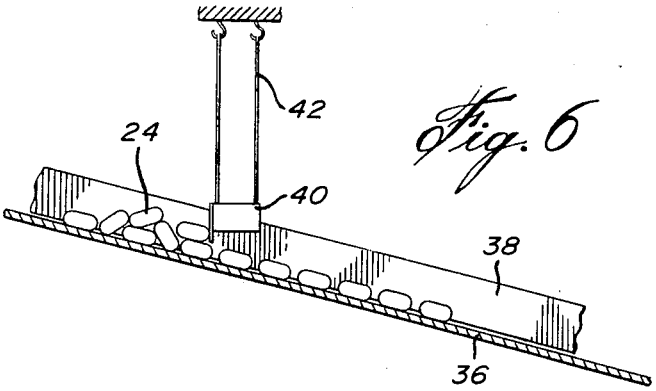
FIG. 6 is a partial longitudinal sectional view of the moving belt showing an attachment to restrict the single row of moving items to one tier.
Figure 7:
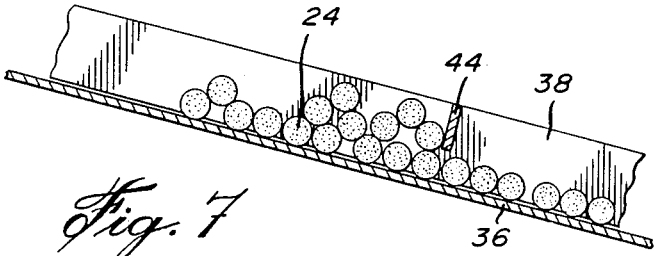
FIG. 7 is a partial longitudinal sectional view similar to that of FIG. 6 showing another embodiment of an attachment to restrict the single row of moving items to one tier.

The items 24 move off the bottom plate 30 of the slot 28 onto a moving belt 36 which slopes downwards and moves downwards. The belt speed is arranged so that the items are shuffled from a multi tier of rows as shown in FIG. 3 into a single row one tier high and two vertical guides 38 as illustrated in FIG. 4 are stationary and located above the belt 36. The guides 38 are set apart a predetermined distance to allow a single row of items to move down the belt. FIG. 6 illustrates elongated capsules moving in a single row down the belt 36 and a weight 40 hanging on wires 42 knocks any second tier of capsules backwards to ensure the capsules pass in a single row only one tier high. FIG. 7 illustrates circular tablets 24 which roll down the belt 36. A restrictor member 44 ensures that tablets are not more than one tier high and forces tablets in the second tier into tablets spaces between the single row of tablet in the first tier.

Figures 5, 8:
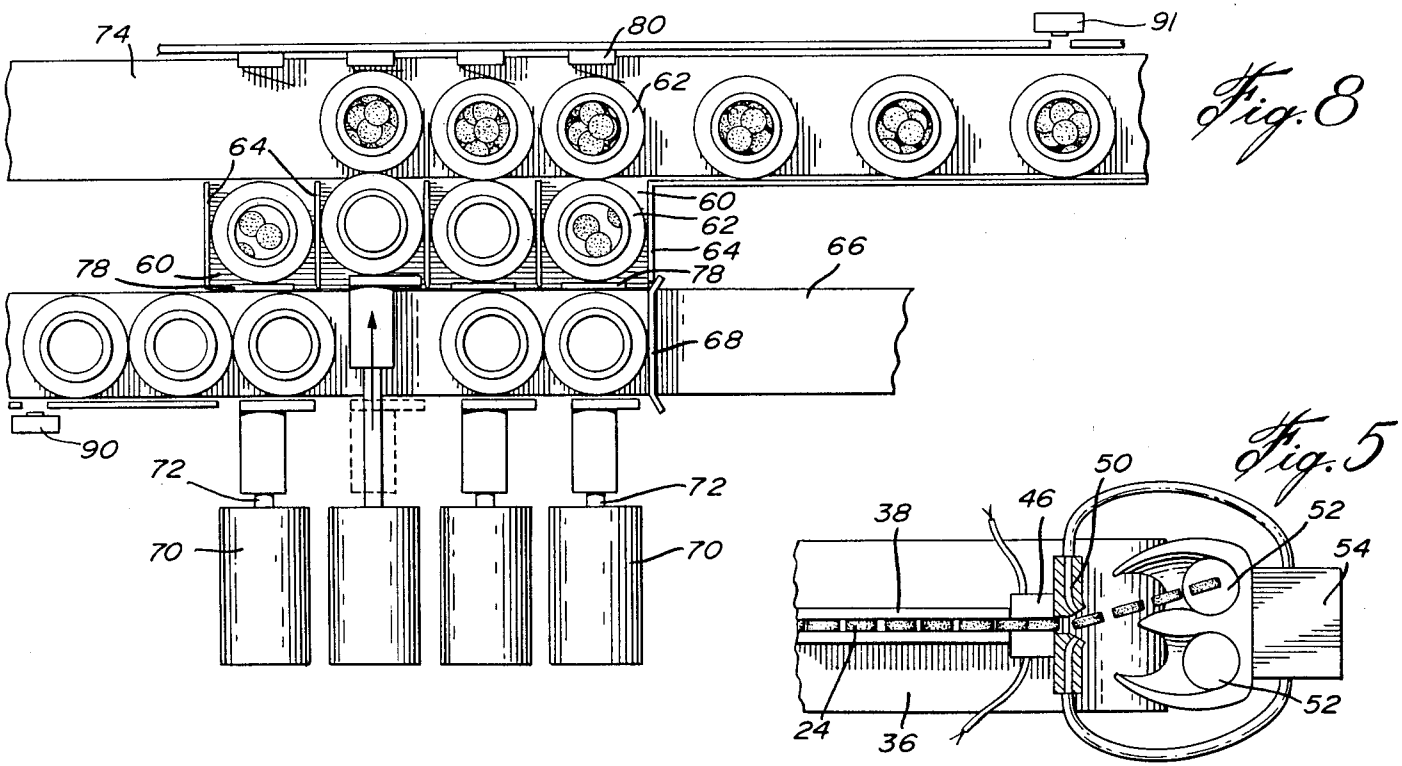
FIG. 5 is a partial top view showing the diverter taken at line 5—5 of FIG. 1.
FIG. 8 is a top view showing the loading positions for containers taken at line 8—8 of FIG. 1.

As may be seen in FIG. 5, the items 24 either roll or are conveyed on the belt 36 past an electronic counter 46 which comprises a light source on one side and an electronic sensor positioned on the other side of the row of items 24 on the belt 36, so that every item 24 breaks a light beam and is counted. A control panel 48 shown in FIG 2 allows an operator to set the number of items to be counted and after the correct number of items passes the electric counter 46, a diverter 50 diverts the single row of items into one of two channels 52. The diverter 50 comprises two air jets operated by an air control valve 54. In operation as soon as the predetermined number of items 24 has been counted, the air jet which is operating is turned off and the other air jet is turned on, thus the air jet diverts the items 24 from one channel 52 to the other channel. This procedure is followed each time the predetermined number of items is counted.

As shown in FIG. 2, the channels 52 have guide tubes 56 leading to discharge outlets 58. The device has two single rows of tablets which are each divided to produce four loading positions 60. The position of the discharge outlets 58 and guide tubes 56 can be adjusted to suit different sizes of containers 62. FIG. 8 illustrates four loading positions 60 with containers 62 in place. Fixed guides 64 position each container 62 which may be bottles, plastic containers, boxes or other types of containers. Whereas the guides 64 are fixed, they may be repositioned to different fixed positions for different sizes of containers 62. A container input conveyor 66 brings empty containers 62 to one side of each of the loading positions 60. A stop 68 prevents the containers 62 from passing beyond the last loading position 60. At the side of each loading position 60 are air cylinders 70 with rams 72 designed to push a container 62 into the adjacent loading position 60 and at the same time, push out a full container from the loading position 60 onto an output conveyor 74. A further air cylinder 76 raises and lowers a gate 78 at the side of each of the loading positions 60 in conjunction with the operation of each of the rams 72. The gate 78 is lowered before the ram 72 pushes an empty container 62 into the loading position 60. A sensing switch 80 is positioned on the other side of the output conveyor 74 opposite each loading position 60. The sensing switch prevents the ram 72 operating if a container 62 is in that location.

In operation, the input conveyor 66 forms a lineup of empty containers 62 ready for positioning into each of loading positions 60. As soon as the electronic counter 46 counts the desired number of items 24 into a container, the diverter 50 switches the single row of items 24 to the other channel 52, the gate 78 in the particular loading position 60 is lowered and the ram 72 pushes an empty container 62 into the loading position 60. The empty container 62 pushes out the full container 60 onto the output conveyor 74. The ram 72 returns to its ready position, the gate 78 is raised to prevent other containers on the input conveyor 66 from pushing against the container 62 in the loading position 60. The input conveyor 66 moves empty containers 62 up to ensure that they are in position for the next loading operation. The operation of each of the loading positions is quite independent of the other. Furthermore, any one of the rams 72 can operate independent of the others. Thus, if one or two loading positions take longer to fill than others, it has no affect whatsoever on the movement of containers through other loading positions. The movement of these containers is controlled by the electronic counter 46, and if there is a delay in items moving in the single row, it will not change the number of items passing into a container.

Infeed sensors 90 and discharge sensors 91 warn the control panel 48 should containers be lacking on the input conveyor 66 or not being cleared away on the output conveyor 74. The complete machine is turned off by shutting off the first and second vibrator 20 and 26, and stopping the belt 26.

Figure 9:
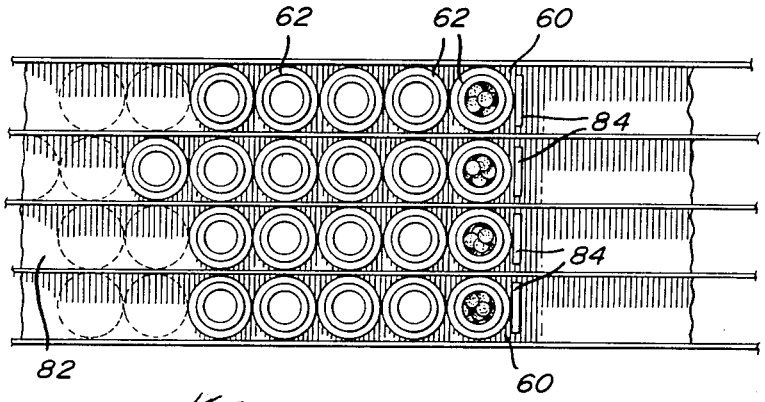
FIG. 9 is a top view of another embodiment showing loading positions for the present device.

Another embodiment of a loading system is shown in FIG. 9 wherein a single wide conveyor 82 or four separate conveyors side by side, is continually moving, bringing containers 62 up to removable gates 84 such that four containers are located in four loading positions 60. As each container 62 is filled, the counter opens the particular gate 84 allowing a full container to move ahead on the conveyor 82. The gate 84 is immediately replaced after the full container 82 passes by so that an empty container 62 is in the loading position 60.

To commence operation of the device, it is merely necessary to turn on the first vibrator 20 beneath the hopper 10 ensuring that the second vibrator 26 is already operating and the electronic counter 46 is set for the predetermined number of items required in a container. Once the containers are placed on the input conveyor 66, the system is controlled by the electronic counter 46, because it counts each item and diverts a predetermined number into a container. The apparatus is accurate as it does not rely on weight of items or time. It has been found that item speeds of from 2,000 to 4,000 per minute can be counted and loaded from each single line. Whereas two lines are shown in the existing drawing, it will be understood that more lines may be utilized. In some cases the moving belt 36 may be a broad belt with guides for individual lines or in another embodiment, several belts may be utilized.

Belt speeds may be changed to suit speed and size of items. All the elements of the device contacted by the items are easily dissambled for cleaning and adjustment for different sizes and types of items. It is merely necessary to adjust the hopper feed 12 on the hopper 10, increase or reduce the size of the slot 28, and the distance between the guides 38 above the belt 36. The slope of the trough 22 and the belt 36 can be varied for different items. Furthermore, the loading positions can be adjusted to suit different sized containers, thus complete flexibility of the device for different sizes and different quantities of items and containers may be achieved.

Various changes may be made without departing from the scope of the present invention which is limited only by the following claims.

The embodiments of the invention in which an exclusive property or privilege is claimed are defined as follows:

1. A device for counting and loading a predetermined number of items into containers, comprising:

(A) a hopper for holding a plurality of items to be counted and loaded, the hopper having an adjustable feed gate to vary flow rate of items from the hopper, first vibrating means to cause the items to flow from the feed gate;

(B) V-guide sorting trough positioned beneath the feed gate, the trough having a slot at the bottom of the trough to hold a single row of items, second vibrating means attached to the trough to funnel items into a single row moving along the slot;

(C) Moving belt means for receiving items from the slot, the belt means having two vertical stationary guides positioned above the belt means to maintain the single row of items therebetween on the belt means;

(D) electronic counting means to count a predetermined number of items moving in the single row on the belt means;

(E) diverter means to direct the predetermined number of items into one of at least two diverter streams, and (F) loading position under each of the diverter streams with means for positioning and removing containers into each loading position independently.

2. The device according to claim 1 wherein the V-guide sorting trough is sloping.

3. The device according to claim 1 wherein the belt means slopes and moves downwards away from the slot.

4. The device according to claim 3 wherein the items are circular tablets which roll on edge in the slot at the bottom of the trough and between the guides above the belt means.

5. The device according to claim 1 wherein the items are capsules.

6. The device according to claim 1 wherein the items are caplets.

7. The device according to claim 1 wherein the width of the slot at the bottom of the trough and the distance between the two guides above the belt means is adjustable for different sizes of items.

8. The device according to claim 2 wherein the slope of the V-guide sorting trough, is adjustable for different sizes of items and different flow rates.

9. The device according to claim 3 wherein the slope and speed of the belt means is adjustable for different sizes of items and different flow rates.

10. The device according to claim 1 wherein means are provided in association with the two guides above the belt means to prevent more than one tier of the single row of items to move along the belt means.

11. The device according to claim 1 including a photo-sensor means positioned above the V-guide sorting trough to sense a pileup of items in the trough and turn off the first vibrating means causing the flow of items from the feed gate to cease.

12. The device according to claim 1 wherein the electronic counting means includes a sensor positioned on one side of the single row of items moving along the belt one side of the single row of items moving along the belt means and a light source on the other side of the single row of items.

13. The device according to claim 1 wherein the diverter means includes two air jets positioned one on either side of the single row of items moving along the belt means to divert the items into a first diverter stream and a second diverter stream, air being directed from only one jet at a time, and being switched to the other jet when the counting means counts the predetermined number of items.

14. The device according to claim 1 wherein the containers are removed from each loading position by a signal from the counting means after counting the predetermined number of items.

15. The device according to claim 1 wherein a plurality of feed gates are provided from the hopper, each feed gate having a V-guide sorting trough positioned therebeneath, each trough providing a single row of items moving down the belt means to the diverter means and to a plurality of loading positions.

16. The device according to claim 1 wherein an even number of loading positions are provided, each loading position having independent means for positioning and removing containers therefrom.

17. The device according to claim 1 including a container input conveyor on one side of the loading positions and a container output conveyor on the other side of the loading positions;

stop means to hold empty containers on the input conveyor adjacent each of the loading positions, and independent ram means for each of the loading position for pushing an empty container into each of the loading positions, the empty container displacing a full container from each of the loading positions onto the output conveyor.

18. The device according to claim 17 wherein each of the loading positions can be changed to suit different sized containers.

19. The device according to claim 17 including container sensor means to prevent a full container from one loading position being pushed onto another full container on the output conveyor.

20. The device according to claim 17 including a container infeed sensor means to stop the device from operating should there be no more containers on the input conveyor.

21. The device according to claim 17 including a container discharge sensor means to stop the device from operating should the containers not discharge correctly from the output conveyor.

22. The device according to claim 1 wherein the diverter means includes at least one air jet positioned adjacent the single row of items moving along the belt means to divert the row of items from a first stream to a second stream when air is directed from the air jet.

* * * * *